US005709316A

United States Patent [19]

Jolly et al.

[11] Patent Number: 5,709,316

[45] Date of Patent: Jan. 20, 1998

[54] CUP DISPENSER

[75] Inventors: John W. Jolly, Waukesha; Scott J. Collins, Brown Deer, both of Wis.

[73] Assignee: Lake Geneva Spindustries, Inc., Lake Geneva, Wis.

[21] Appl. No.: 644,253

[22] Filed: May 10, 1996

[51] Int. Cl.[6] ..... A47F 1/04

[52] U.S. Cl. ..... 221/304; 221/307

[58] Field of Search ..... 221/303, 304, 221/310, 241, 221, 63, 307; 312/43

[56] References Cited

U.S. PATENT DOCUMENTS

| | | | |
|---|---|---|---|
| 3,790,023 | 2/1974 | Filipowicz | 221/304 |
| 4,234,101 | 11/1980 | Pastore | 221/241 |
| 4,482,079 | 11/1984 | Kuchenbecker | 221/310 |
| 4,482,080 | 11/1984 | Pawlowski et al. | 221/310 |
| 4,854,479 | 8/1989 | Callahan et al. | 221/304 |
| 5,199,601 | 4/1993 | Roethel | 221/310 |

*Primary Examiner*—Kenneth Noland
*Attorney, Agent, or Firm*—Michael, Best & Friedrich

[57] ABSTRACT

The dispenser is adapted to dispense different size cups, such as portion cups, and includes a housing for storing a plurality of cups in a nested stack and a flexible diaphragm covering the discharge end of the housing. The diaphragm includes a web section having a central discharge opening through which the bottom of the outermost cup of the stack extends to be grasped and withdrawn from the stack. The discharge opening preferably has a symmetrical polygonal shape, such as a hexagonal shape, and has an inner periphery configured to retain a stack of the smallest cups to be dispensed in the housing while permitting the outermost cup in the stack to be drawn from the housing. The web section also includes a plurality of circumferentially spaced apertures which are also spaced radially outwardly from the inner periphery of the discharge opening such that, when material between all circumferentially adjacent apertures is severed, the effective size of the inner periphery of the discharge opening is enlarged sufficiently to permit the outermost cup in a stack of a predetermined larger size to be withdrawn from the stack while retaining the stack in the housing. To provide the capability of dispensing up to five or more different size cups, circumferentially spaced, radially extending rows of these apertures can be provided.

20 Claims, 2 Drawing Sheets

CUP DISPENSER

BACKGROUND OF THE INVENTION

This invention relates to cup dispensers and, more particularly, to cup dispensers adapted to dispense cups of different diameters, such as portion cups.

In some commercial establishments, particularly fast food establishments and convenience grocery stores, paper cups typically are dispensed from dispensers including a tubular housing containing a stack of cups and mounted on a wall, supported on some kind of base resting on a counter or mounted beneath a counter. The housing of a wall-mounted dispenser is mounted in a vertical position. The housing for base-supported dispensers is vertical, horizontal or at an acute angle. In both cases, the rim of the lowermost cup in the stack is supported on a flexible retainer, such ledges, tabs or some kind of diaphragm, located in the lower end of the housing. By pulling downward on the lowermost cup, the rim of the cup can pass over the retainer and be withdrawn from the housing.

With counter-mounted dispensers, the housing is located beneath the counter with the upper end accessible from above the counter top. The stack of cups is urged upwardly within the housing by a spring and the rim of the uppermost cup is supported beneath a flexible retainer located adjacent to the upper end of the housing. As a cup is withdrawn from the housing, the spring force urges the stack upwardly to a location where succeeding cups can be withdrawn.

Another type cup dispenser is in the form of a portable box-like paper board package containing a stack of cups and having a central discharge opening through which cups can be pulled off the stack.

Most cup dispensers are designed to dispense only a single size diameter of cup. Consequently, if cups of different sizes are to be dispensed, the dispenser must be replaced by one capable of dispensing the other size cups.

Various approaches have been used to provide cup dispensers with a capability of dispensing cups having different diameters. In one approach, the retainer consists of a flexible diaphragm having a central discharge opening and plurality of circumferentially spaced, radially extending slits which form flap segments to retain all but the outermost cup in the stack. Such a diaphragm cannot accommodate relatively small differences in cup diameter. If the radial slits are long enough to accommodate cups having diameters ranging from more than ¾ inch from the smallest to the largest, the flap segments forming the discharge opening are too loose to effectively restrain the smallest diameter cups. Consequently, several cups can be withdrawn at the same time. On the other hand, if the slits are shortened to tighten engagement for smaller cups, the effective opening can be too tight for the largest diameter of cups, making it difficult for a customer to withdraw a cup. This is particularly undesirable when small paper portion cups for catsup, mustard, salad dressing, souffle, etc., are being dispensed because a customer can crush cups being withdrawn from the stack.

In another approach, the housing opening includes a plurality of circumferentially spaced, radially inwardly extending flexible retainers for releasably engaging the rim of a cup and a mechanism, such as a cam arrangement, for adjusting the radial location of the retainers. Examples of this approach are disclosed in Filipowicz U.S. Pat. No. 3,790,023, Pastore U.S. Pat. No. 4,234,101 and Callahan et al. U.S. Pat. No. 4,854,479.

In another approach, the stack of cups is retained by an elastomeric diaphragm, including a plurality of circumferentially spaced, radially extending fingers defining the discharge opening. An example of this approach is disclosed in Roethal U.S. Pat. No. 5,199,601.

Kuchenbecker U.S. Pat. No. 4,482,079 which discloses a portable dispensing package having a plurality of circumferentially spaced, radial slits surrounding the discharge opening and Pawlowski et al. U.S. Pat. No. 4,482,080 which discloses a portable dispenser package including a combination of straight segments and circumferentially spaced radial slits surrounding the discharge opening. Neither of these patents address making the discharge opening capable of dispensing different diameter cups.

SUMMARY OF THE INVENTION

The principal object of the invention is to provide a cup dispenser including a diaphragm for releasably retaining a stack of cups which is arranged to permit dispensing of different size cups, such as portion cups.

Another object of the invention is to provide such a diaphragm in which the size of the discharge opening can be conveniently enlarged for different size cups.

A further object of the invention is to provide such a diaphragm which can be conveniently replaced when it is desired to dispense smaller cups.

Other objects, advantages and aspects of the invention will become apparent to those skilled in the art upon reviewing the following detailed description, the drawings and the appended claims.

The invention provides a dispenser adapted to dispense different diameter cups, such as portion cups for condiments and the like, including a housing for storing a plurality of the cups in a nested stack and a flexible diaphragm covering the discharge end of the housing. The diaphragm includes a web section having a central discharge opening through which the bottom of the outermost cup of the stack extends to be grasped and withdrawn from the stack. The opening has an inner periphery configured to retain a stack of the smallest cups to be dispensed in the housing while permitting the outermost one to be withdrawn from the stack. The web section also includes a plurality of circumferentially spaced apertures spaced radially outwardly from the inner periphery of the diaphragm discharge opening such that, when the material between all circumferentially adjacent apertures is severed, the effective size of the inner periphery of the diaphragm discharge opening is enlarged sufficiently to permit the outermost cup in a stack of a predetermined larger size cups to be withdrawn from the stack while retaining the stack in the housing.

The diaphragm discharge opening preferably has a symmetrical polygonal shape, such as a hexagonal shape, and the apertures are generally located at an axis extending radially outwardly from the center of the diaphragm discharge opening and through an inner section of adjoining straight segments forming the inner periphery of the discharge opening.

When the dispenser is to be used for dispensing more than two different size cups, the diaphragm can be provided with a plurality of circumferentially spaced rows of the apertures with the apertures in each row being radially spaced relative to each other and relative to the inner periphery of the discharge opening such that, when the web material between all circumferentially adjacent first apertures in each row is severed, the effective size of the inner periphery of the discharge opening is enlarged sufficiently to permit the outermost cup in the stack of a first predetermined larger size to be withdrawn from the stack while retaining the stack in the housing and when the web material between all circumferentially adjacent second apertures in each row is severed, the effective size of the inner periphery of the discharge opening is enlarged sufficiently to permit the outermost cup in a stack of cups of a second predetermined larger size, larger than the first larger size, to be withdrawn from the stack while retaining the stack in the housing. With an appropriate spacing of the apertures in each row, the dispenser can be capable of dispensing up to five or more different size cups.

The dispenser preferably includes means for positively restraining radially inwardly movement of the diaphragm when a cup is being withdrawn through the discharge opening so as to maintain the portion of the web section surrounding the discharge opening taunt enough to apply a sufficient pressure to the underside of the rim and/or body of the cups to minimize the possibility of two or more cups being pulled off the stack at a time.

DETAILED DESCRIPTION

While the invention can be adapted for wall-mounted and base-supported dispensers used for dispensing a wide variety of different size and type cups, such as hot or cold paper or foam cups, it is particularly adaptable for counter-mounted dispensers for dispensing small paper portion cups for condiments, such as catsup, mustard, salad dressing, souffle, etc., and similar substances, and will be described in connection with that application.

Figures 1, 2, 3, 4:
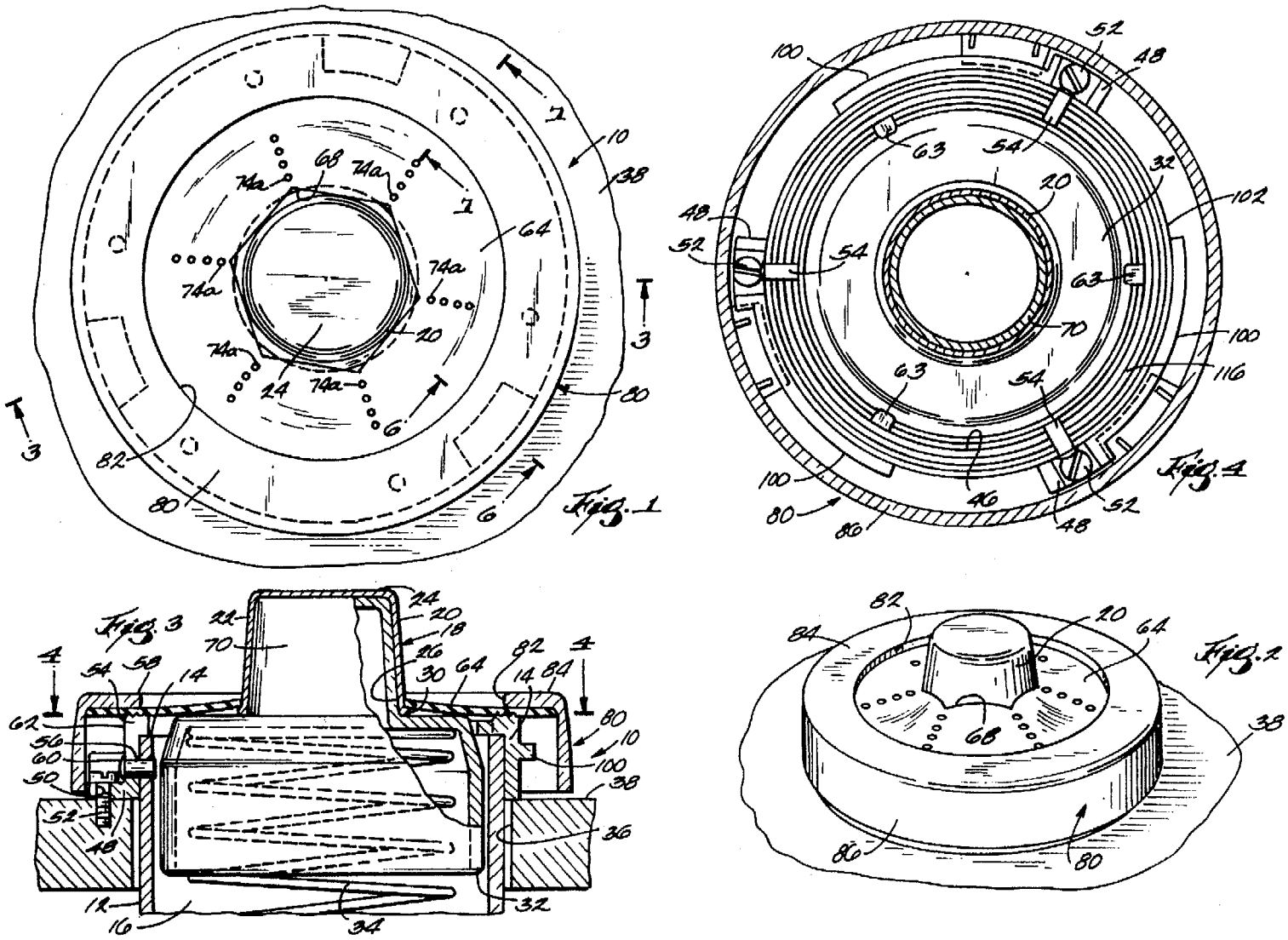
FIG. 1 is a top plan view of a counter-mounted dispenser embodying various features of the invention.
FIG. 2 is a reduced perspective view of the top of the dispenser illustrated in FIG. 1 from above a counter top.
FIG. 3 is a fragmentary, partially broken away and partially cross sectional view taken generally along line 3–3 in FIG. 1.
FIG. 4 is a sectional view taken generally along line 4—4 in FIG. 3.

FIGS. 1, 2 and 3 illustrate a mounted cup dispenser 10 embodying the invention. The dispenser 10 includes an elongated, tubular and generally cylindrical housing 12 having an end cap (not shown), an open upper or discharge end 14 and a chamber 16 for holding an inverted stack 18 (one shown) of nested, disposable paper portion cups 20. Each cup 20 has a tapered or frusto-conical side wall 22, a bottom wall 24 and an open top surrounded by a radially outwardly extending rim 30 which can be rolled in the usual manner or any other suitable configuration. The stack 18 of cups 20 rests on a platform 32 which is urged upwardly toward the discharge end 14 of the housing 12 by a spring 34 disposed between the end cap of the housing 12 and the platform 32. The upper portion of the housing 12 extends through an aperture 36 in a counter top 38.

Figures 5, 6, 7, 8, 9:
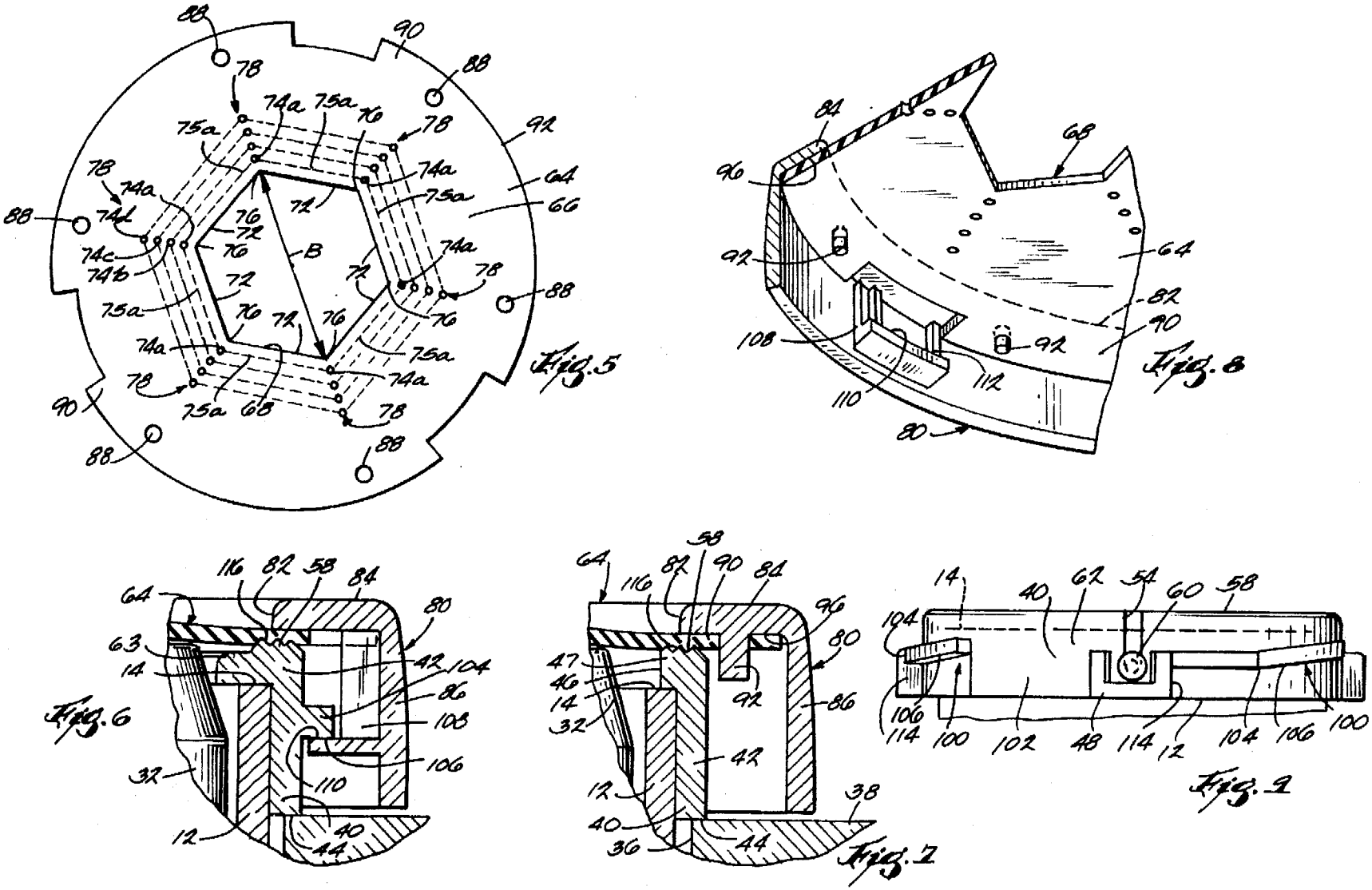
FIG. 5 is a top plan view of the diaphragm in the dispenser illustrated in FIG. 1.
FIG. 6 is an enlarged, fragmentary, cross sectional view taken generally along line 6—6 in FIG. 1.
FIG. 7 is an enlarged, fragmentary, cross sectional view taken generally along line 7—7 in FIG. 1.
FIG. 8 is an enlarged, fragmentary perspective view of the underside of the retaining ring and diaphragm.
FIG. 9 is a reduced side elevation view of the mounting ring shown mounted on the housing with only the top portion of the housing illustrated.

The housing 12 is retained in place by a mounting ring 40 including an annular sleeve portion 42 which surrounds the counter top aperture 36 with the bottom edge 44 resting on the counter top 38. The mounting ring 40 has a central opening 46 generally coaxial with the discharge end 14 of the housing 12 and surrounded by a rim 47 (FIG. 7). The sleeve portion 42 has a plurality (e.g., 3) of circumferentially spaced, radially outwardly extending mounting tabs 48 (FIGS. 3 and 4) which rest on the counter top 38. Each mounting tab 48 has an aperture 50 through which a mounting screw 52 extends and is screwed into the counter top 38 to fasten the mounting ring 40 in place. As best shown in FIGS. 3 and 9, the sleeve portion 42 also includes a plurality (e.g., 3) of circumferentially spaced, axially extending slots 54 for receiving a like number of radially outwardly extending pins 56 on the upper end of the housing 12.

In the specific construction illustrated, as best shown in FIG. 9, the slots 54 coincide with the mounting tabs 48 and are open at the outer or top edge 58 on the rim 47 of the mounting ring 40 and have a width approximately by slightly larger than the outside diameter of the pins 56 to minimize rotation of the housing 12 relative to the mounting ring 40 after full installation. As illustrated, the pins 56 preferably have an enlarged head 60 which engages the outer surface 62 of the sleeve portion 42 to restrain radial movement of the housing 12 relative to the mounting ring 40.

As best shown in FIGS. 3, 4 and 6, upward movement of the platform 32 is limited by a plurality (e.g., 3) radially extending tabs 63 on the upper portion of the sleeve portion 42 of the mounting ring 40.

Covering the discharge end 14 of the housing 12 is a flexible diaphragm 64 including a web section 66 and a central opening 68 through which the bottom portion of the outermost cup 20 in the stack 18 is urged upwardly by the spring 34 acting on the platform 30. The platform 30 has a centrally located, upwardly extending frusto-conical protuberance 70 which extends above the counter top 38 and over which the lower-most cup 20 fits to generally axially align the stack 18 of cups 20 with the diaphragm opening 68.

The diaphragm opening 68 is configured and dimensioned so that portions of the web section 66 surrounding the opening 68 engage the underside of the rim 30 of the outermost cup 20 as best shown in FIG. 3. This engagement must be releasable in the sense that the outermost cup 20 can be withdrawn or pulled off a stack 18 without crushing and yet a sufficient force is applied on the rim and/or body of the next cup 20 to restrain it from being pulled off the stack. For example, for the dispenser 10 to be capable of dispensing ¾, 1, 1¼, 2, and 2½ ounce portion cups, the minimum inside dimension of the diaphragm opening 68 must be less than the outside diameter of the rim of the ¾ ounce cups. The diaphragm opening 68 (FIG. 5) preferably has a symmetrical polygonal shape and includes straight segments 72 which engage the rim and/or body of the cups, preferably a hexagonal shape as illustrated. However, the diaphragm opening 68 can be generally circular or any other shape which provides the desired engagement with the rims of the particular size cups being disposed.

The diaphragm 64 preferably made from suitable elastomeric material capable of providing the function described above, such as silicone rubber.

As a guide, when the dispenser 10 will be used to dispense the above five sizes of paper portion cups, the diaphragm 64 can be made from a silicone rubber material having a Durometer of about 60 and a thickness of about 0.062 inches. The dimension between opposed intersections 76 of the straight segment 72 (dimension A in FIG. 5) for ¾ ounce cups is about 1.463 inches.

To provide the capability of dispensing more than one size cup, the web section 66 of the diaphragm 64 (FIG. 5) has a plurality of circumferentially spaced small apertures 74*a* (e.g., 0.60 inch diameter) spaced radially outwardly from the inner periphery of the diaphragm opening 68. If the dispenser 10 is to be capable of dispensing two size cups, the apertures 74*a* are located such that, when the web material between circumferentially adjacent apertures 74*a* is severed by a knife, scissors, or the like as illustrated by the dashed lines 75*a* in FIG. 5, the effective size of the diaphragm opening 68 is enlarged sufficiently to permit the larger size cups to be pulled from the stack and yet there is sufficient engagement with the rim and/or sidewalls of the next cup 20 to retain it from being pulled off the stack. When the diaphragm opening 68 is polygonal as illustrated, the apertures 74*a* are located on a radial axis extending from the center of the diaphragm opening 68 and through the intersections 76 of the straight segments 72.

The diaphragm 64 (FIG. 5) can be adapted to dispense several different size cups by providing a row 78 of apertures at each aperture location. The number of apertures in each row 78 correspond to the number of larger size cups the dispenser will be capable of dispensing. For example, in the embodiment illustrated, the diaphragm 64 is designed to be capable of dispensing ¾, 1, 1¼, 2 and 2½ ounce portion cups. The diaphragm opening 68 is dimensioned for ¾ ounce cups and apertures 74*a*, 74*b*, 74*c* and 74*d* are for 1, 1¼, 2 and 2½ ounce cups, respectively. As a guide, the radial spacing between apertures 74*a* and 74*b*, 74*b* and 74*c*, and 74*c* and 74*d* can be about 0.095, 0.095, 0.112 and 0.116 inch, respectively.

The diaphragm 64 is held in place on the mounting ring 40 by a retaining ring 80 which fits over and is removably connected to the mounting ring 40. The retaining ring 80 has a central opening 82 generally coaxial with the diaphragm opening 68, an annular shoulder 84 extending radially outwardly from the opening 82 and a peripheral flange 86 depending from the shoulder 84. The diaphragm 64 preferably is removably mounted on the retaining ring 80. In the specific construction illustrated, the diaphragm 64 has a plurality (e.g., 6) of circumferentially spaced apertures 88 in the outer peripheral portion 90 and spaced radially inwardly from the outer perimeter 92 of the diaphragm 64. The retaining ring 80 has an equal number of posts 92 (FIG. 8) extending axially from the inner surface 96 of the shoulder 84 toward the discharge end 14 of the housing 12. The apertures 88 in the diaphragm 64 fit snugly over the posts 94 so that the diaphragm 64 can be installed on the retaining ring and carried thereby when the retaining ring 80 is fitted over the mounting ring 40 during installation. When the retaining ring 80 is installed, the outer peripheral portion 90 of the diaphragm 64 is disposed between the top edge 58 of the mounting ring 40 and the inner surface 96 of the retaining ring shoulder 84.

The portion of the web section 66 surrounding the diaphragm opening 68 preferably is maintained taunt enough to apply a sufficient force on the under side of the rim and/or body of the cups to minimize the possibility of two or more being pulled off a stack at a time. This can be accomplished by positively restraining radially inward movement of the web section 66 when a cup is being withdrawn through the diaphragm opening 68. The posts 92 on the retaining ring 80 serve this purpose in part.

The retaining ring 80 and the mounting ring 40 preferably include clamping means for sandwiching or squeezing the outer peripheral portion 90 of the diaphragm 64 between the top edge 58 of the mounting ring 40 and the inner surface 96 of the retaining ring 80. In the specific construction illustrated, the mounting ring 40 (FIGS. 4 and 9) includes a plurality (e.g., 3) of circumferentially spaced ramps 100 projecting radially outwardly from the outer periphery 102 of the mounting ring 40. Each ramp 100 has a generally circumferentially extending ramp guide surface 104 including a portion 106 which slopes in a direction away from the inner surface 96 of the retaining ring 80, i.e., downwardly to the left as viewed in FIG. 9.

As best shown in FIGS. 6 and 8, the retaining ring 80 has a plurality (e.g., 3) of guide members 108 on the inner periphery of the flange 86 corresponding in number with the ramps 100 on the mounting ring 40. Each guide member 108 has a cam surface 110 which extends beneath and engages a ramp guide surface 104 during rotation of the retaining ring 80 (in a clockwise direction as viewed in FIGS. 6 and 9) relative to the mounting ring 40 during installation. As the cam surface 110 rides along the sloped portion 106 of the ramp guide surface 104, the inner surface 96 of the retaining ring shoulder 84 moves axially downward relative to the top edge 58 of the mounting ring 40, causing the outer peripheral portion 90 of the diaphragm 64 to be tightly squeezed therebetween. Rotation of the retaining ring 80 is continued until the leading edges 112 (FIG. 8) engage a side 114 (FIG. 9) of the mounting tabs 48.

Either the top edge 58 of the mounting ring 40, the inner surface 96 of the retaining ring shoulder 84 or both preferably is provided with a plurality of concentric serrations 116 which further restrain radially inwardly movement of the diaphragm 64 after the retaining ring 80 has been installed as described above.

Dispensers incorporating a diaphragm with above-described arrangement can be sold to dispense any one of the above-described size portion cups. If the user is initially going to use the dispenser to dispense cups larger than ¾ ounce, he or she can cut the web material between the circumferentially adjacent apertures for the particular larger size cup. For example, if 1 ounce cups are to be dispensed, the user would cut the material between all the apertures 74*a*. If the user later desires to dispense 2 ounce cups, he or she would cut the web material between all the apertures 74*c*. If the user later desires to dispense smaller cups, all he or she has to do is replace the diaphragm with either an uncut one when the smallest size cup is to be dispensed or one cut to the appropriate apertures for a larger size cup. In situations where a dispenser might be used to dispense all five size cups at one time or another, the user could have five diaphragms ready for use, an uncut one and the other four cut to different apertures.

From the foregoing description, one skilled in the art can easily ascertain the essential characteristics of the invention and, without departing from the spirit and scope thereof, make various changes and modifications to adapt it to various usages.

We claim:

1. A dispenser adapted to dispense different diameter cups having a tapered sidewall, a bottom wall and an open top surrounded by a radially outwardly extending outer rim, said dispenser comprising:

a housing for storing a plurality of the cups in a nested stack and having a discharge end; and a flexible diaphragm covering the discharge end of said housing and including a web section including a central discharge opening through which the bottom of the outermost cup in the stack extends to be grasped and withdrawn from the stack, said opening having an inner periphery configured to retain a stack of the smallest cups to be dispensed in the housing while permitting the outermost cup in the stack to be withdrawn from the stack, and a plurality of circumferentially spaced apertures in said web section and spaced radially outwardly from the inner periphery of said central opening such that, when material between all circumferentially adjacent apertures is severed, the effective size of the inner periphery of said discharge opening is enlarged sufficiently to permit the outermost cup in a stack of predetermined larger size cups to be withdrawn from the stack while retaining the stack in the housing.

2. A dispenser according to claim 1 wherein the inner periphery of said diaphragm discharge opening has a symmetrical polygonal shape.

3. A dispenser according to claim 2 wherein the inner periphery of said diaphragm discharge opening includes adjoining straight segments; and each of said apertures is generally located on an axis extending radially outwardly from the center of said diaphragm discharge opening and through an intersection of said adjoining segments.

4. A dispenser according to claim 3 wherein the inner periphery of said diaphragm discharge opening has a hexagonal shape.

5. A dispenser according to claim 1 wherein said diaphragm is made from an elastomeric material.

6. A dispenser according to claim 1 including:

a plurality of circumferentially spaced rows of said apertures in said web section with said apertures in each row being radially spaced relative to each other and relative to the inner periphery of said diaphragm discharge opening such that, when the web material between all circumferentially adjacent first apertures in each row is severed, the effective size of the inner periphery of said diaphragm discharge opening is enlarged sufficiently to permit the outermost cup in a stack of cups of a first predetermined larger size to be withdrawn from the stack while retaining the stack in the housing; and when the web material between all circumferentially adjacent second apertures in each row is severed, the effective size of the inner periphery of said diaphragm discharge opening is enlarged sufficiently to permit the outermost cup in a stack of cups of a second predetermined larger size, larger than said first predetermined larger size, to be withdrawn from the stack while retaining the stack in the housing.

7. A dispenser according to claim 1 including retaining means for positively restraining radially inward movement of said diaphragm relative to the discharge end of said housing when a cup is being withdrawn from the stack.

8. A dispenser according to claim 7 wherein said retaining means comprises a retaining ring fitting over the discharge end of said housing and said diaphragm and having a central opening generally coaxial with said diaphragm discharge opening and an annular shoulder extending radially outwardly from the central opening of said retaining ring and having an inner surface facing the discharge end of said housing;

a mounting ring surrounding and connected to the portion of said housing including said discharge end, said mounting ring including an annular rim having an outer surface facing the inner surface of said retaining ring, said diaphragm having an outer peripheral portion disposed between the inner surface of said retaining ring and the outer surface of said mounting ring; and clamping means on said retaining ring and said mounting ring cooperating to cause the outer peripheral portion of said diaphragm to be squeezed between the inner surface of said retaining ring and the outer surface of said mounting ring.

9. A dispenser according to claim 1 wherein at least one of the inner surface of said retaining ring and the outer surface of said mounting ring includes a plurality of concentric annular serrations.

10. A dispenser according to claim 8 wherein said clamping means comprises:

said mounting ring having an outer peripheral surface and a plurality of circumferentially spaced ramps projecting radially outwardly from said outer peripheral surface, each of said ramps having a generally circumferentially extending guide surface including a portion which slopes in a direction away from the inner surface of said retaining ring; and said retaining ring having a plurality of circumferentially spaced guide members extending axially inwardly relative to the inner surface thereof and corresponding in number with said ramps, each of said guide members having a cam surface for engaging the guide surface of a said ramp and cooperating therewith such that, during a predetermined rotation of said retaining ring relative to said mounting ring, the inner surface of said retaining ring is moved axially toward the outer surface of said mounting ring a sufficient distance to tightly squeeze the outer peripheral portion of said diaphragm therebetween.

11. A counter top dispenser adapted to dispense different diameter portion cups having a tapered sidewall, a bottom wall and an open top surrounded by a radially outwardly extending outer rim, said dispenser comprising:

a housing located beneath the counter for storing a plurality of the cups in an inverted, nested stack and having a discharge end extending through an opening in the counter top;

a mounting ring surrounding and connected to a portion of the discharge end of said housing extending through the counter top opening, said mounting ring adapted to rest on the counter top in the vicinity of the counter top opening;

a flexible diaphragm covering the discharge end of said housing and including a web section including a central discharge opening through which the bottom of the outermost cup in the stack extends to be grasped and withdrawn from the stack, said opening having an inner periphery configured to retain a stack of the smallest cups to be dispensed in the housing while permitting the outermost cup in the stack to be withdrawn from the stack; and a plurality of circumferentially spaced apertures in said web section and spaced radially outwardly from the inner periphery of said central opening such that, when material between all circumferentially adjacent apertures is severed, the effective size of the inner periphery of said diaphragm discharge opening is enlarged sufficiently to permit the outermost cup in a stack of predetermined larger size cups to be withdrawn from the stack while retaining the stack in the housing; and means for holding said diaphragm in place over the discharge end of said housing.

12. A dispenser according to claim 11 wherein the inner periphery of said diaphragm discharge opening has a symmetrical polygonal shape.

13. A dispenser according to claim 12 wherein the inner periphery of said diaphragm discharge opening includes adjoining straight segments; and each of said apertures is generally located on an axis extending radially outwardly from the center of said diaphragm discharge opening and through an intersection of said adjoining segments.

14. A dispenser according to claim 13 wherein the inner periphery of said diaphragm discharge opening has a symmetrical hexagonal shape.

15. A dispenser according to claim 14 wherein said diaphragm is made from an elastomeric material.

16. A dispenser according to claim 11 including:

a plurality of circumferentially spaced rows of said apertures in said web section with said apertures in each row being radially spaced relative to each other and relative to the inner periphery of said diaphragm discharge opening such that, when the web material between all circumferentially adjacent first apertures in each row is severed, the effective size of the inner periphery of said diaphragm discharge opening is enlarged sufficiently to permit the outermost cup in a stack of cups of a first predetermined larger size to be withdrawn from the stack while retaining the stack in the housing; and when the web material between all circumferentially adjacent second apertures in each row is severed, the effective size of the inner periphery of said diaphragm discharge opening is enlarged sufficiently to permit the outermost cup in a stack of cups of a second predetermined larger size, larger than said first predetermined larger size, to be withdrawn from the stack while retaining the stack in the housing.

17. A dispenser according to claim 11 including retaining means for positively restraining radially inward movement of said diaphragm relative to the discharge end of said housing when a cup is being withdrawn from the stack.

18. A dispenser according to claim 17 wherein said retaining means comprises a retaining ring fitting over the discharge end of said housing and said diaphragm and having a central opening generally coaxial with said diaphragm discharge opening and an annular shoulder extending radially outwardly from the central opening of said retaining ring and having an inner surface facing the discharge end of said housing;

said mounting ring including an annular rim having an outer surface facing the inner surface of said retaining ring, said diaphragm having an outer peripheral portion disposed between the inner surface of said retaining ring and the outer surface of said mounting ring; and clamping means on said retaining ring and said mounting ring cooperating to cause the outer peripheral portion of said diaphragm to be squeezed between the inner surface of said retaining ring and the outer surface of said mounting ring.

19. A dispenser according to claim 18 wherein said clamping means comprises:

said mounting ring having an outer peripheral surface and a plurality of circumferentially spaced ramps projecting radially outwardly from said outer peripheral surface, each of said ramps having a generally circumferentially extending guide surface including a portion which slopes in a direction away from the inner surface of said retaining ring; and said retaining ring having a plurality of circumferentially spaced guide members extending axially inwardly relative to the inner surface thereof and corresponding in number with said ramps, each of said guide members having a cam surface for engaging the guide surface of a said ramp and cooperating therewith such that, during a predetermined rotation of said retaining ring relative to said mounting ring, the inner surface of said retaining ring is moved axially toward the outer surface of said mounting ring a sufficient distance to tightly squeeze the outer peripheral portion of said diaphragm therebetween.

20. A dispenser according to claim 19 wherein at least one of the inner surface of said retaining ring and the outer surface of said mounting ring includes a plurality of concentric annular serrations.

* * * * *